US008333159B2

(12) United States Patent
Schroer et al.

(10) Patent No.: US 8,333,159 B2
(45) Date of Patent: Dec. 18, 2012

(54) VETERINARY TABLE ASSEMBLY WITH ROTATABLE TABLE

(75) Inventors: Joseph Schroer, Leawood, KS (US); Perry Crow, Lawson, MO (US)

(73) Assignee: Schroer Manufacturing Company, Kansas City, KS (US)

( * ) Notice: Subject to any disclaimer, the term of this patent is extended or adjusted under 35 U.S.C. 154(b) by 113 days.

(21) Appl. No.: 12/899,010

(22) Filed: Oct. 6, 2010

(65) Prior Publication Data

US 2012/0085270 A1 Apr. 12, 2012

(51) Int. Cl.
*A47B 9/00* (2006.01)

(52) U.S. Cl. ..... 108/147; 119/753

(58) Field of Classification Search ..... 108/20, 108/21, 22, 147, 94; 119/753, 674; 5/611, 5/11, 601

See application file for complete search history.

(56) References Cited

U.S. PATENT DOCUMENTS

| | | | | | |
|---|---|---|---|---|---|
| 810,181 | A | * | 1/1906 | Barth | 119/753 |
| 1,166,018 | A | | 12/1915 | Soresi | |
| 1,648,631 | A | | 11/1927 | Austin | |
| 1,947,801 | A | | 2/1934 | Russell | |
| 1,980,848 | A | | 11/1934 | Cass | |
| 2,471,884 | A | | 5/1949 | Monnot | |
| 2,504,697 | A | | 4/1950 | Kearsley | |
| 2,552,473 | A | * | 5/1951 | Whitman | 108/94 |
| 2,663,929 | A | * | 12/1953 | Carpenter | 74/89.32 |
| 3,092,079 | A | | 6/1963 | Stebel et al. | |
| 3,120,836 | A | | 2/1964 | Brauning | |
| 3,217,672 | A | | 11/1965 | Haughey | |
| 3,285,207 | A | | 11/1966 | Vom Hagen | |
| 3,420,981 | A | | 1/1969 | Martinet | |
| 3,608,462 | A | * | 9/1971 | Groshong | 108/20 |
| 3,617,693 | A | | 11/1971 | Shimosawa | |
| 3,633,901 | A | * | 1/1972 | Lindquist | 119/753 |
| 3,771,782 | A | | 11/1973 | Anderegg | |
| 4,003,341 | A | | 1/1977 | La Croix | |
| 4,170,961 | A | | 10/1979 | Rosenberg et al. | |
| 4,459,941 | A | | 7/1984 | Moffatt | |
| 4,491,173 | A | | 1/1985 | Demand | |
| 4,558,847 | A | | 12/1985 | Coates | |
| 4,572,493 | A | | 2/1986 | Hubert | |

(Continued)

FOREIGN PATENT DOCUMENTS

GB 772032 4/1957

OTHER PUBLICATIONS

Shor-Line, "Rediscover Quality", 2011 Product Catalog, CoJack-Plus Multi-Purpose Table, p. 35, this item was on sale in the United States more than one year prior to Oct. 6, 2010, the filing date of this application.

(Continued)

*Primary Examiner* — Jose V Chen

(74) *Attorney, Agent, or Firm* — Stinson Morrison Hecker LLP

(57) ABSTRACT

A veterinary table assembly having a support assembly and a table mounted to the support assembly. The table is operable to rotate with respect to the support assembly at least approximately 90 degrees between a first position and a second position. Preferably, the table is also operable to move vertically between a lowered position and a raised position. The table assembly also preferably includes a back panel mounted to the support assembly for restraining an animal on the table.

32 Claims, 13 Drawing Sheets

U.S. PATENT DOCUMENTS

| | | | | |
|---|---|---|---|---|
| 4,924,781 | A * | 5/1990 | Span | 108/22 |
| 4,960,271 | A * | 10/1990 | Sebring | 5/611 |
| 5,013,018 | A * | 5/1991 | Sicek et al. | 5/611 |
| 5,324,911 | A | 6/1994 | Cranston et al. | |
| 5,490,296 | A * | 2/1996 | Fleury et al. | 5/611 |
| 5,590,429 | A * | 1/1997 | Boomgaarden et al. | 5/611 |
| 6,101,956 | A | 8/2000 | Keil | |
| 6,195,578 | B1 * | 2/2001 | Distler et al. | 5/601 |
| 6,435,110 | B1 | 8/2002 | Keil | |
| 6,651,273 | B2 * | 11/2003 | Vilsmeier | 5/11 |
| 6,651,279 | B1 * | 11/2003 | Muthuvelan | 5/601 |
| 6,877,442 | B2 * | 4/2005 | Helle | 108/147 |
| 7,024,710 | B2 * | 4/2006 | Izuhara | 5/611 |
| 7,073,464 | B2 | 7/2006 | Keil | |
| 7,204,193 | B2 * | 4/2007 | Scherrer et al. | 108/43 |
| 7,373,676 | B2 | 5/2008 | Markovic et al. | |
| 7,428,882 | B2 | 9/2008 | Keil | |
| 7,810,187 | B2 * | 10/2010 | Van Es et al. | 5/601 |
| 8,096,007 | B2 * | 1/2012 | Dyreby et al. | 5/611 |
| 2003/0053599 | A1 * | 3/2003 | Meyer et al. | 378/196 |
| 2007/0125314 | A1 | 6/2007 | Keil | |
| 2007/0245977 | A1 | 10/2007 | Keil | |

OTHER PUBLICATIONS

Shor-Line, "Rediscover Quality", 2011 Product Catalog, Mobile Animal Lift Table, p. 36, this item was on sale in the United States more than one year prior to Oct. 6, 2010, the filing date of this application.

Shor-Line, "Rediscover Quality", 2011 Product Catalog, Lift Exam Table, p. 36, this item was on sale in the United States more than one year prior to Oct. 6, 2010, the filing date of this application.

Shor-Line, "Rediscover Quality", 2011 Product Catalog, Shor-Line Classic Flat-Top Surgery Table, p. 43, this item was on sale in the United States more than one year prior to Oct. 6, 2010, the filing date of this application.

Shor-Line, "Rediscover Quality", 2011 Product Catalog, Shor-Line Classic V-Top Surgery Table, p. 43, this item was on sale in the United States more than one year prior to Oct. 6, 2010, the filing date of this application.

Suburban Surgical Co., Inc., Brochure, Premier Lift Tables, p. 120, this item was on sale in the United States more than one year prior to Oct. 6, 2010, the filing date of this application.

VSSI, Inc., Brochure, The Peninsula Folding Lift Table, this item was on sale in the United States more than one year prior to Oct. 6, 2010, the filing date of this application.

Welch Allyn, Brochure, "Morin Surgical Instruments", dated Nov. 1, 1994 (this document is in French but an English translation is also being provided) (5 pgs).

* cited by examiner

VETERINARY TABLE ASSEMBLY WITH ROTATABLE TABLE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates generally to tables used by animal care professionals and, more particularly, to a veterinary table assembly having a rotatable tabletop.

2. Description of Related Art

A variety of different tables are used by animal care professionals to treat, examine and otherwise provide services for companion animals such as dogs and cats. These include surgery, examination, transport and grooming tables to name a few. The tables come in many different shapes and sizes and are constructed out of various materials. Typically, these tables consist of an elevated surface or tabletop mounted on a base. An animal is positioned on the tabletop in order to be examined or receive other treatments.

The design features of animal care tables vary widely. Most tables are freestanding but some are mounted on a wall or otherwise affixed to a support structure. Although many tables are stationary in nature, there are mobile tables that allow an animal to be transported into or within a care center. Some tables have a fixed working height, while others allow the height of the tabletop to be raised or lowered. Tabletops generally have a horizontal orientation but some can be tilted or otherwise adjusted. Various tables are equipped with features allowing an animal to be tethered or otherwise secured while on the tabletop.

Even though a table may have a specific designation, animal care professionals will often use a table for various functions. However, certain tables do have special features that make them well suited for a particular use. Surgery tables typically have height and position adjustable tabletops that are large enough to accommodate various surgical procedures for animals of various sizes. Examination tables may be equipped with weighing capabilities, special restraint features and storage capacity. Transport tables are mobile. Grooming tables have special tethering devices.

In their simplest form, fixed height examination tables consist of a tabletop mounted on a stationary base. The base can be columnar, have a plurality of legs or consist of a cabinet with drawers and compartments for storage. Another common type of fixed height table is affixed to a wall or other support structure. The simplicity and relative affordability of these tables made them the industry standard for many years. In more recent years, adjustable height tables were introduced consisting of a tabletop mounted on or to a base or frame containing a lifting mechanism that allows the tabletop to be raised and lowered. With these tables, animal handling issues are minimized because the animal may be placed on the tabletop when the tabletop is in a lowered position. These tables also provide a variety of tabletop working heights to accommodate different procedures and practitioners of various heights.

Adjustable height tables can be divided into two main groups depending on whether the tabletop is positioned directly above or perpendicular to the lifting mechanism. Tables with the tabletop above the lifting mechanism commonly deploy a scissors lift design. They are often mobile and can serve as an animal transport unit. Tables with a tabletop configured perpendicular to the lifting mechanism normally house that mechanism in a separate vertical structure from which the tabletop is cantilevered. These tables tend to be stationary and are often equipped with a back panel or other features to secure an animal while on the table.

Adjustable height tables with the perpendicular tabletop configuration fall into one of two categories depending on the orientation of the tabletop relative to the structure housing the lifting mechanism. In some tables, the tabletop extends width-wise from the structure, while in others it extends length-wise. One common element for all such tables is that the tabletop is fixed in either its width-wise or length-wise orientation. As such, when a practitioner purchases a table, a fundamental and irreversible determination is made about the nature and manner of examinations or other services to be performed on the table.

There are inherent advantages and disadvantages associated with the different tabletop orientations. A table with a width-wise oriented tabletop and back panel provides the maximum amount of flexibility to secure an animal on the tabletop. The back panel protects against the animal falling off the back of the tabletop. However, the back panel also restricts access to the side of the animal against the panel. On the other hand, a length-wise oriented tabletop and back panel allows a practitioner full access to both sides of an animal. It also offers more flexibility for carrying out certain procedures. However, with both sides of the tabletop open, there is less security with this configuration.

BRIEF SUMMARY OF THE INVENTION

The present invention is directed to a veterinary table assembly comprising a table mounted to a support assembly. The table is operable to rotate with respect to the support assembly at least approximately 90 degrees between a first position (wherein the table is in a width-wise orientation) and a second position (wherein the table is in a length-wise orientation). Preferably, the table is also operable to move vertically between a lowered position and a raised position. The table assembly also preferably includes a back panel mounted to the support assembly for restraining an animal on the table.

In an exemplary embodiment, the support assembly comprises a column and a carriage operable to move vertically with respect to the column so as to move the table between the lowered and raised positions. The carriage includes an extension arm that is slideably mounted to a frame and an L-shaped box. The back panel is mounted to the L-shaped box, and the table is mounted to the extension arm. The table and extension arm are slideable with respect to the frame and L-shaped box in a direction that is generally perpendicular to the back panel. The table is then rotatable with respect to the extension arm between the first and second positions. The table is generally rectangular and includes a pair of side edges that extend the length of the table and a pair of end edges that extend the width of the table. One of the side edges is adjacent to the back panel when the table is in the first position, and one of the end edges is adjacent to the back panel when the table is in the second position.

In operation, the table is moved to the lowered position so that an animal can be placed on the table. If the practitioner determines that access is only needed to one side of the animal, then the table is rotated to the first position (wherein the table is in a width-wise orientation). If the practitioner determines that access is needed to both sides of the animal, then the table is rotated to the second position (wherein the table is in a length-wise orientation). With the table in the desired position, the animal is placed on the table and the animal's leash is tied to a rail on the back panel so as to restrain the animal. The table is then moved to the raised position. If the table is in the first position, one side of the animal on the table can be examined, while the opposite side of the animal faces the back panel for increased security. If the table is in the second position, both sides of the animal can be examined. Thus, the practitioner may selectively position the table as desired in view of the nature of the examination to be performed on a particular animal.

DETAILED DESCRIPTION OF EXEMPLARY EMBODIMENT

The present invention is directed to a veterinary table assembly with a rotatable table. While the invention will be described in detail below with reference to an exemplary embodiment, it should be understood that the invention is not limited to the specific configuration of this embodiment. In addition, although the exemplary embodiment is described as embodying several different inventive features, one skilled in the art will appreciate that any one of these features could be implemented without the others in accordance with the invention.

Figure 1:
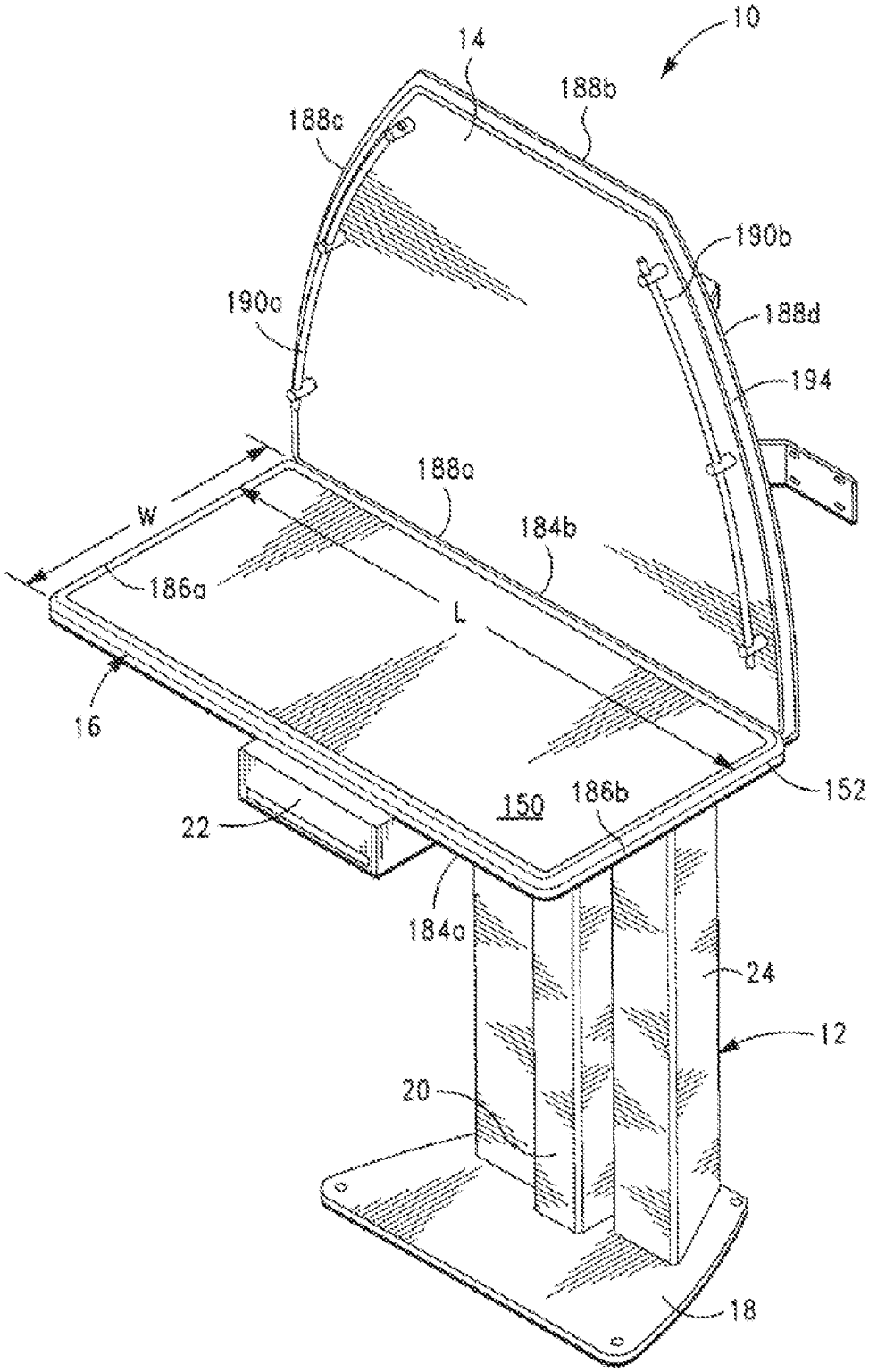
FIG. 1 is a perspective view of a veterinary table assembly showing a table in a width-wide orientation relative to a back panel.

Referring to FIG. 1, a veterinary table assembly according to an exemplary embodiment of the present invention is shown generally as reference numeral 10. The veterinary table assembly 10 includes a support assembly 12, as well as a back panel 14 and table 16 that are each mounted to support assembly 12. Support assembly 12 includes a base plate 18, a column 20 mounted to and extending upwardly from base plate 18, a carriage 22 slideably mounted to column 20, and a shroud 24 that covers a portion of column 20. As described in detail below, back panel 14 and table 16 are mounted to the carriage 22 of support assembly 12. However, it is within the scope of the invention for the back panel 14 to be mounted to another portion of the support assembly 12, such as column 20.

Figure 2:
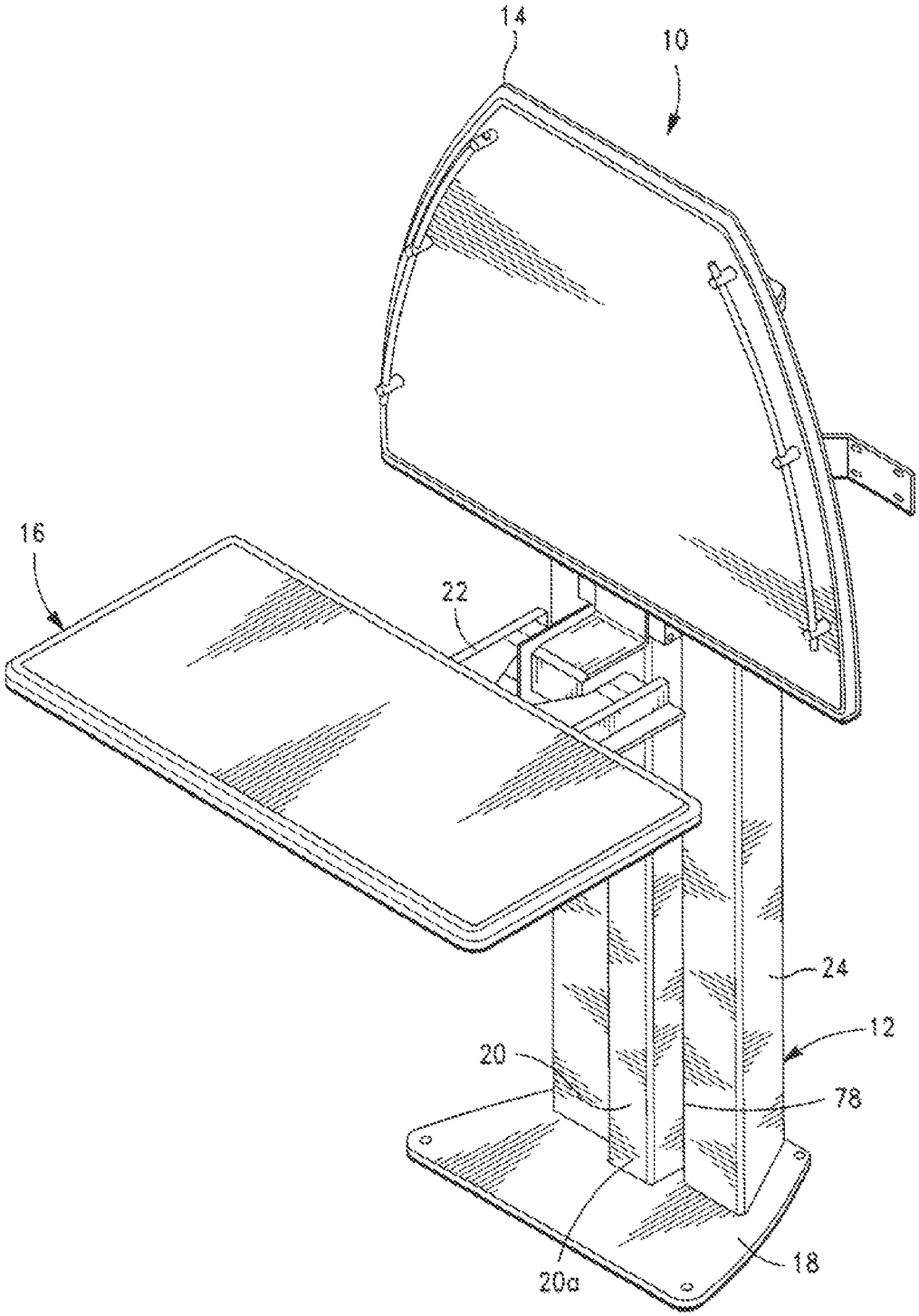
FIG. 2 is a perspective view of the veterinary table assembly showing the table slid away from the back panel.
Figure 3:
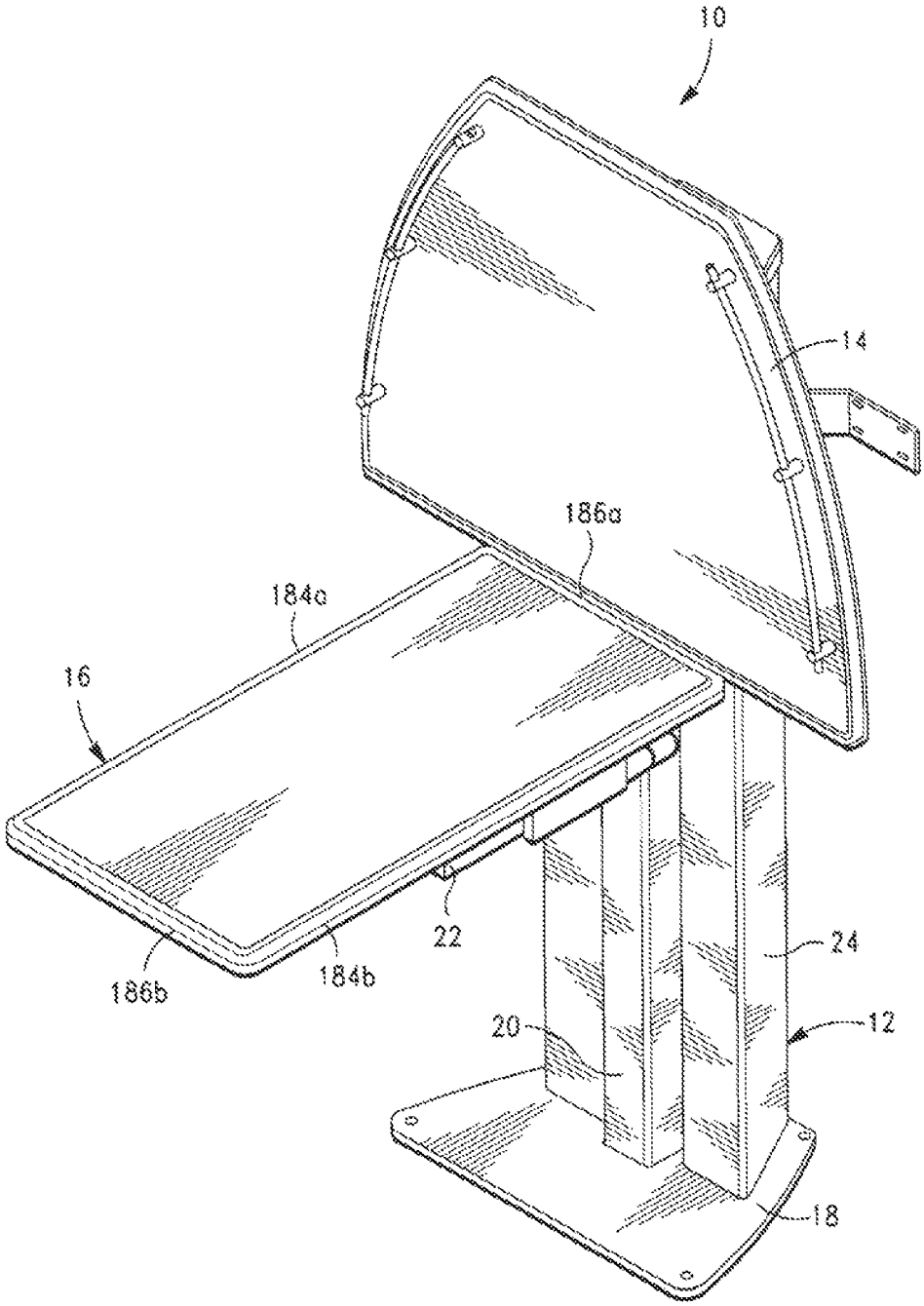
FIG. 3 is a perspective view of the veterinary table assembly showing the table rotated ninety degrees to a length-wise orientation relative to the back panel.
Figure 4:
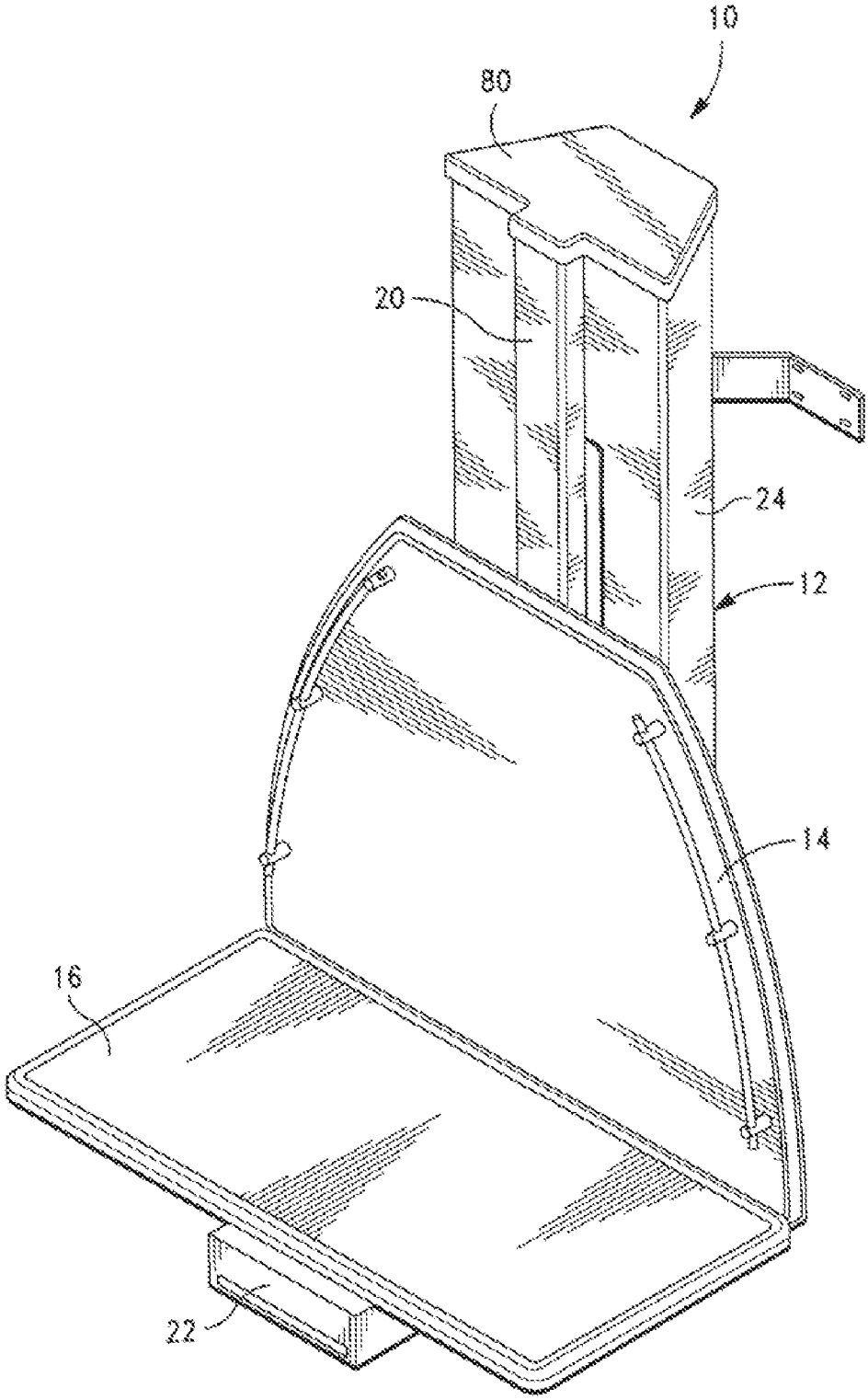
FIG. 4 is a perspective view of the veterinary table assembly showing the table and back panel in a lowered position.

As shown in FIGS. 1-4, the table 16 is moveable with respect to the support assembly 12 so that an operator of the table assembly 10 can position the table 16 as desired. For example, as shown in FIGS. 1 and 4, the carriage 22 and table 16 are vertically moveable with respect to support assembly 12 in order to make it easier for an operator of the table assembly 10 to get an animal on table 16. When table 16 is in the lowered position shown in FIG. 4, an animal may step on or be placed on the table 16. Then, the table 16 may be raised to the raised position shown in FIG. 1 so that a practitioner can examine the animal. Preferably, the table 16 is approximately 8.5 inches above base plate 18 when in its lowered position and approximately 47.5 inches above base plate 18 when in its raised position. The table 16 and carriage 22 may be set at any intermediate height between the raised and lowered positions via the actuator mechanism described in detail below.

The table 16 is also operable to horizontally slide and rotate with respect to carriage 22 so that the table 16 can be moved between the position shown in FIG. 1 and the position shown in FIG. 3. When the table 16 is in the position shown in FIG. 1 (i.e., a width-wise orientation), one side of an animal positioned on the table is accessible to a practitioner and the other side of the animal faces the back panel 14. The width-wise orientation is desirable when access to both sides of the animal is not necessary because the animal is more secure than when the table is in the position shown in FIG. 3. When the table 16 is in the position shown in FIG. 3 (i.e., a length-wise orientation), which is approximately 90 degrees from the position shown in FIG. 1, both sides of the animal are accessible to a practitioner. However, the animal is less secure than when the table is in the position shown in FIG. 1 To move the table 16 from the position in FIG. 1 to the position in FIG. 3, the table 16 is first slid horizontally in a direction that is perpendicular to back panel 14 to the position shown in FIG. 2. Then, the table 16 is rotated with respect to the carriage 22 to the position shown in FIG. 3. As discussed below, the mechanisms that permit the table 16 to slide and rotate are lockable when the table 16 is in any of the positions shown in FIGS. 1-3 so that the table 16 cannot slide or rotate when locked.

Figure 6:
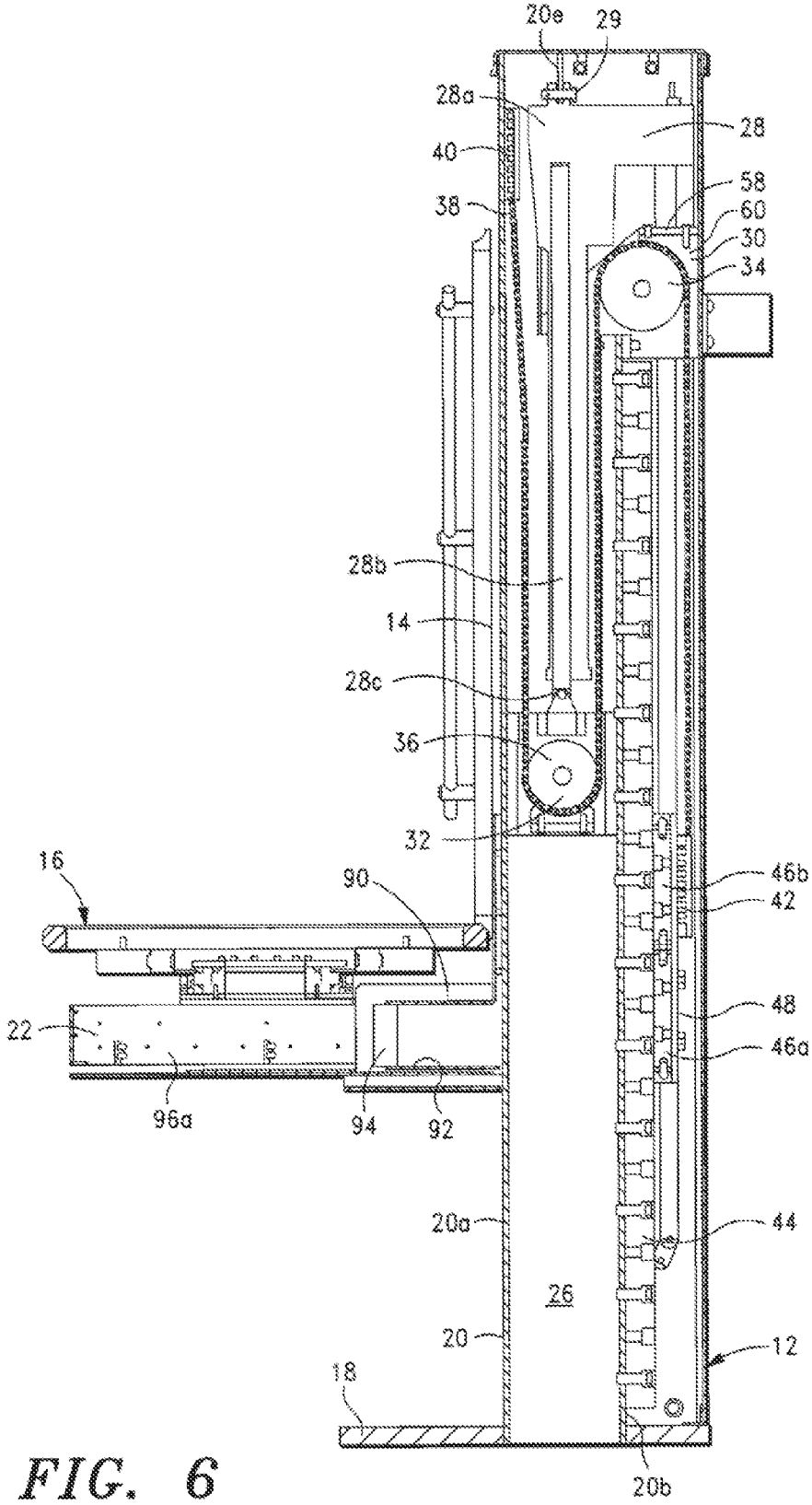
FIG. 6 is a cross-sectional view taken through the line 6-6 in FIG. 5.
Figure 7:
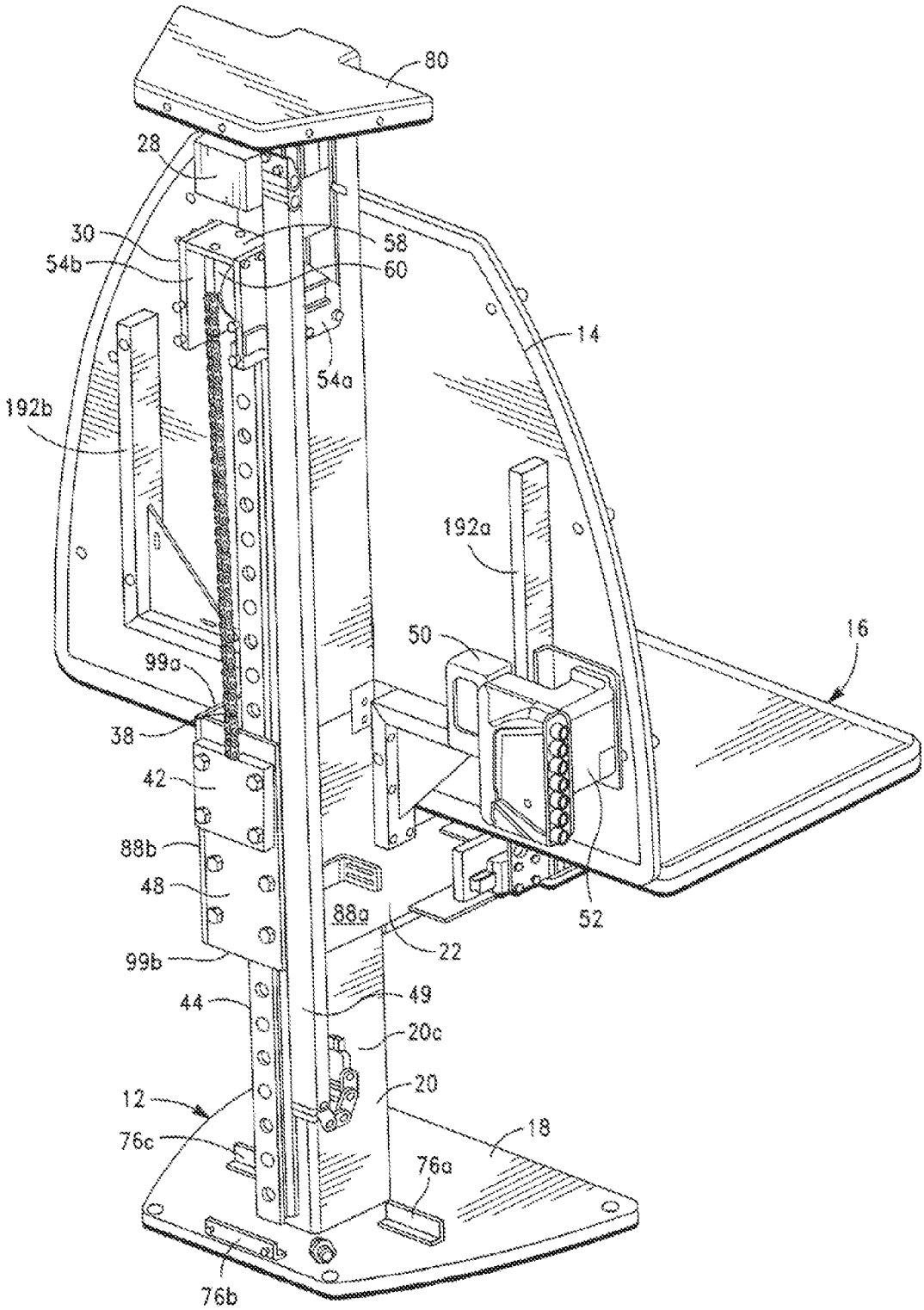
FIG. 7 is a rear perspective view of the veterinary table assembly with a shroud of the assembly removed.
Figure 8:
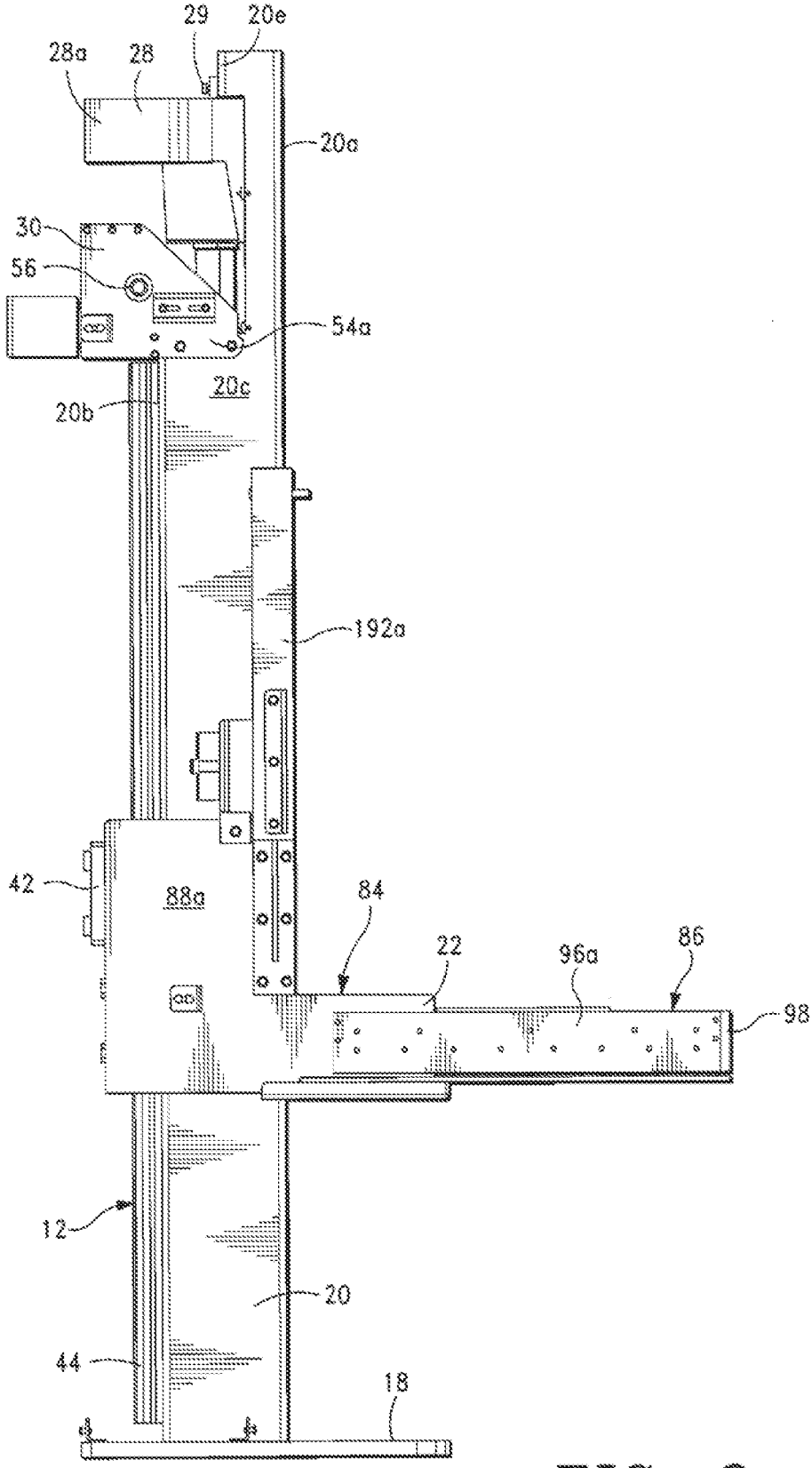
FIG. 8 is a side elevational view of the veterinary table assembly without the table, back panel, and shroud.
Figure 14:
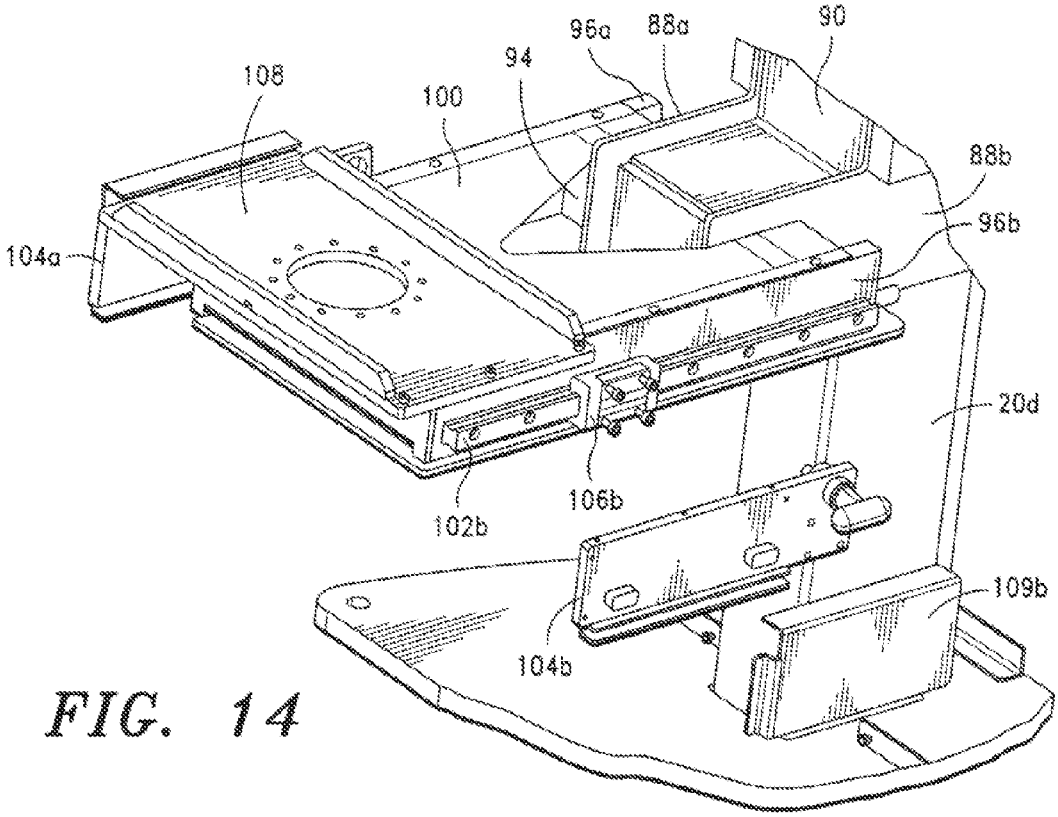
FIG. 14 is a partially exploded perspective view of the bearing support and frame of the carriage.

As best shown in FIGS. 6, 7 and 14, the column 20 of table assembly 10 has a front wall 20*a*, a rear wall 20*b*, and side walls 20*c* and 20*d*. Column 20 is hollow such that walls 20*a*-20*d* enclose an interior space or cavity 26 (FIG. 6). Referring to FIG. 8, a portion of the rear wall 20*b* and side walls 20*c* and 20*d* is removed from the top of the column 20 to provide space for mounting an actuator 28 and upper sprocket assembly 30 to the column 20. As shown in FIGS. 6 and 8, the actuator 28 mounts with a fastener 29 to a wall 20*e* that is parallel to front wall 20*a* and that extends between side walls 20*c* and 20*d*.

Referring to FIG. 6, the actuator 28 includes a housing 28*a*, which is mounted to column 20, and a piston 28*b* that is vertically moveable with respect to the housing 28*a*. The piston 28*b* has a free end 28*c* that is received within the interior space 26 of the column 20. A lower sprocket assembly 32 is mounted to the free end 28*c* of the piston 28*b*. The upper sprocket assembly 30 and lower sprocket assembly 32 have sprockets 34 and 36, respectively. A chain 38 is secured at one end to the top of the front wall 20*a* with a chain clamp 40. The chain 38 extends from clamp 40 downward within the interior space 26 of column 20 to lower sprocket 36. The chain 38 engages and wraps around lower sprocket 36 and extends upwardly to upper sprocket 34. The chain 38 engages and wraps around upper sprocket 34 and extends downwardly to carriage 22. The chain 38 is mounted to the back of carriage 22 with a chain clamp 42.

Chain 38 links actuator 28 with carriage 22 such that downward vertical movement of piston 28*b* causes upward vertical movement of carriage 22 with respect to column 20. As piston 28*b* moves downward within column 20, the amount of chain 38 that is positioned between chain clamp 40 and upper sprocket 34 increases while the amount of chain 38 that is positioned between upper sprocket 34 and carriage 22 decreases to raise carriage 22. Due to the configuration of chain 38 extending around two sprockets 34 and 36, the carriage 22 moves upward at twice the rate that the piston 28*b* moves downward. While a chain 38 and sprockets 34 and 36 are described and shown herein to link actuator 28 and carriage 22, it is within the scope of the invention to use any elongate member and sliding surfaces to vertically raise the carriage 22 with respect to column 20. For example, a belt and pulleys may be substituted for the chain 38 and sprockets 34 and 36 that are described herein. A rail 44 is mounted on the rear wall 20*b* of the column to slideably mount carriage 22 to the column 20. Two guides 46*a* and 46*b* are mounted to the interior surface of a rear wall 48 of the carriage 22. The guides 46*a* and 46*b* engage rail 44 to slideably mount carriage 22 to column 20.

In the exemplary embodiment, actuator 28 is an electrically operated actuator sold by Hiwin under the trade name LAN3. Preferably, actuator 28 has an electrical cord (not shown) that is received by a flexible cord cover 49, shown in FIG. 7. The electrical cord may be plugged into an electrical receptacle 50 mounted to the rear of the back panel 14 that is wired to a power supply 52. The power supply 52 is preferably electrically connected to a building's power supply. A switch (not shown) is preferably provided for actuating downward and upward movement of piston 28*b*. Optionally, the actuator 28 is configured for wireless operation such that a wireless remote control or foot pedal can be used to move piston 28*b*.

Referring to FIG. 7, upper sprocket assembly 30 consists of opposed side plates 54*a* and 54*b* that are mounted to upper portions of column side walls 20*c* and 20*d*, respectively. A shaft 56 (FIG. 8) is received by bearings (not shown) that are positioned within openings in side plates 54*a* and 54*b*. Upper sprocket 34 has an opening that receives shaft 56. Side plates 54*a* and 54*b* are joined to and surround a top plate 58 above sprocket 34. A chain guard 60 is mounted to top plate 58 and extends downward to guide chain 38 around sprocket 34, as shown in FIG. 6, and surround chain 38.

Figure 15:
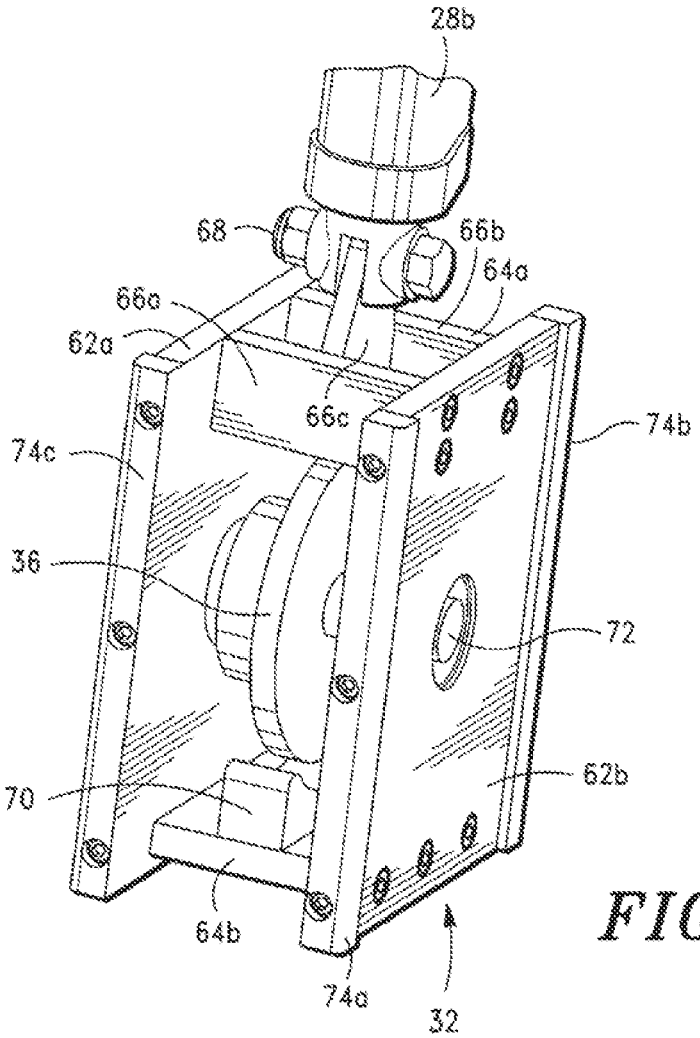
FIG. 15 is a perspective view of a lower sprocket assembly.

As shown in FIG. 15, the lower sprocket assembly 32 includes a pair of opposed side plates 62*a* and 62*b* that are each joined with upper and lower cross-braces 64*a* and 64*b*. The upper cross-brace 64*a* includes two parallel plates 66*a* and 66*b* that are each joined to a mounting plate 66*c*. Mounting plate 66*c* has an opening (not shown) for receiving a fastener 68 to join lower sprocket assembly 32 to actuator piston 28*b*. A chain guard 70 is mounted to lower cross-brace 64*b* to guide chain 38 around sprocket 36 and surround chain 38. A shaft 72 is received by bearings (not shown) that are positioned within openings in side plates 62*a* and 62*b*. Lower sprocket 36 has an opening that receives shaft 72. A pair of low friction sliding surfaces 74*a* and 74*b* are mounted to the side edges of side plate 62*b*. Similarly, a pair of low friction sliding surfaces, one of which is shown in FIG. 15 as 74*c*, are mounted to the side edges of side plate 62*a*. The low friction sliding surfaces 74*a-c* are in direct contact with the interior surfaces of column 20 and enable the lower sprocket assembly 32 to vertically slide within column 20 with minimal friction. The sliding surfaces 74*a-c* are preferably constructed from acetal resin sold under the trademark Delrin. However, the surfaces 74*a-c* may be constructed from any suitable low friction material, such as ultra high molecular weight polyethylene.

Figure 5:
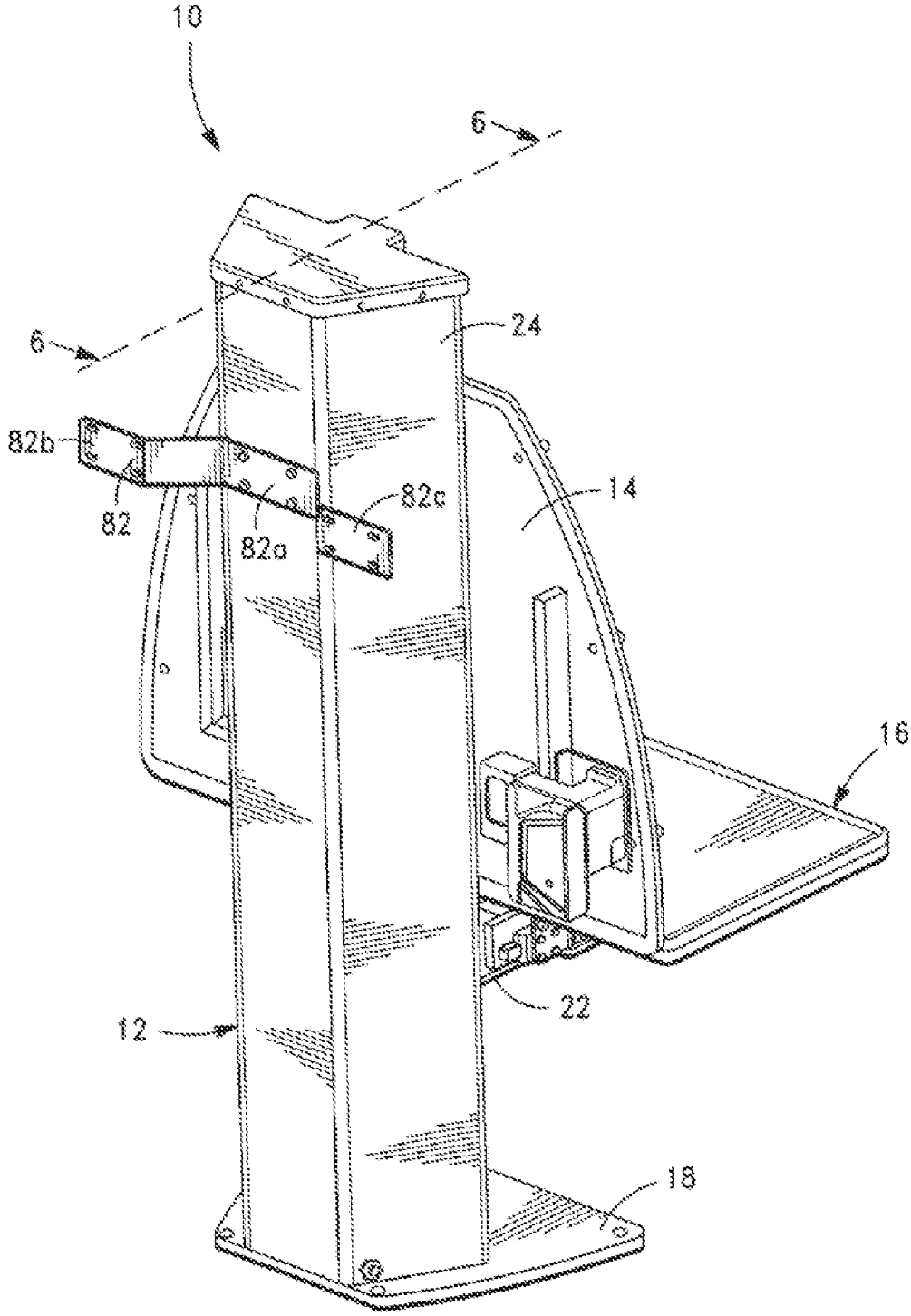
FIG. 5 is a rear perspective view of the veterinary table assembly.

The shroud 24, shown in FIGS. 1-5, mounts to base plate 18 with mounting brackets 76*a-c*, shown in FIG. 7. The shroud 24 encloses a majority of column 20 and actuator 28. As shown in FIG. 2, the front wall 20*a* of column 20 extends through an opening 78 in the front of shroud 24 to permit carriage 22 to vertically slide with respect to column 20. A cover 80, shown in FIG. 4, is mounted to the top of shroud 24 for preventing debris from entering column 20 and shroud 24 from above. Referring to FIG. 5, a wall mounting bracket 82 is mounted to the rear of shroud 24. The wall mounting bracket 82 has a central section 82*a* that mounts to shroud 24 and two side sections 82*b* and 82*c* that extend rearward at an angle from the central section 82*a* for mounting the table assembly 10 to a permanent support surface such as a wall. It is within the scope of the present invention for the table assembly 10 to not have a wall mounting bracket 82 if the assembly 10 is stable without being mounted to a wall. For example, if the assembly 10 has a low center of gravity, a wide base plate, or if the base plate mounts to a floor, then bracket 82 may not be necessary.

Referring to FIG. 8, carriage 22 includes an L-shaped box 84 and a frame 86 extending outwardly from box 84. The box 84 includes a pair of L-shaped side walls 88*a* and 88*b* (FIGS. 7 and 14) each joined with rear wall 48 (FIG. 7), an L-shaped front wall 90 (FIGS. 6 and 14), and a bottom wall 92 (FIG. 6). Frame 86 includes a rear bar 94 (FIGS. 6 and 14) that extends through openings in each of side walls 88*a* and 88*b*, side bars 96*a* and 96*b* (FIG. 14) that are joined with and extend outwardly from rear bar 94, and a front bar 98 (FIG. 8) that is joined with side bars 96*a* and 96*b* opposite rear bar 94. Preferably, the components of carriage 22 are welded together to form an integral structure. There are openings 99*a* and 99*b* (FIG. 7) in the top and bottom of carriage 22 so that the carriage 22 may receive and slide with respect to column 20. As discussed above and shown in FIG. 6, guides 46*a* and 46*b* are mounted to rear wall 48 for engaging the rail 44 mounted to column 20 and permitting carriage 22 to slide with respect to column 20. A cover plate 100, shown in FIG. 14, is mounted to the tops of side bars 96*a* and 96*b*.

Figure 9:
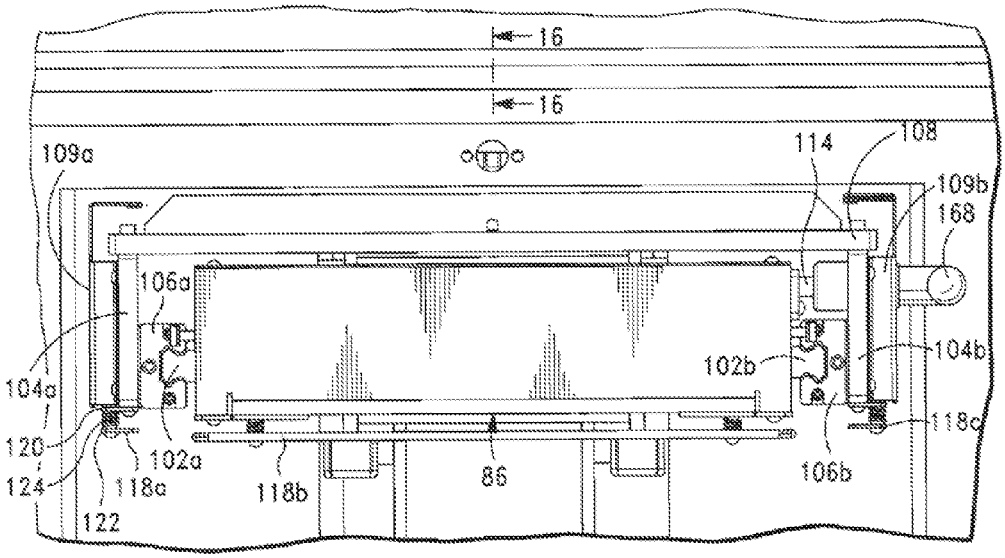
FIG. 9 is a front elevational view of a portion of a table and carriage of the veterinary table assembly.

Referring to FIGS. 9 and 14, carriage 22 also includes rails 102*a* and 102*b* that are mounted to side bars 96*a* and 96*b*, respectively. The carriage 22 has a pair of extension arms 104*a* and 104*b* that are slideably mounted on rails 102*a* and 102*b*, respectively, via guides 106*a* and 106*b* that are mounted to the extension arms 104*a* and 104*b*. A bearing support plate 108 is mounted to upper surfaces of the extension arms 104*a* and 104*b* such that the extension arms 104*a* and 104*b* slide in unison on rails 102*a* and 102*b*. Covers 109*a* and 109*b*, shown in FIG. 9, are mounted to the sides of extension arms 104*a* and 104*b*, respectively.

Figure 10:
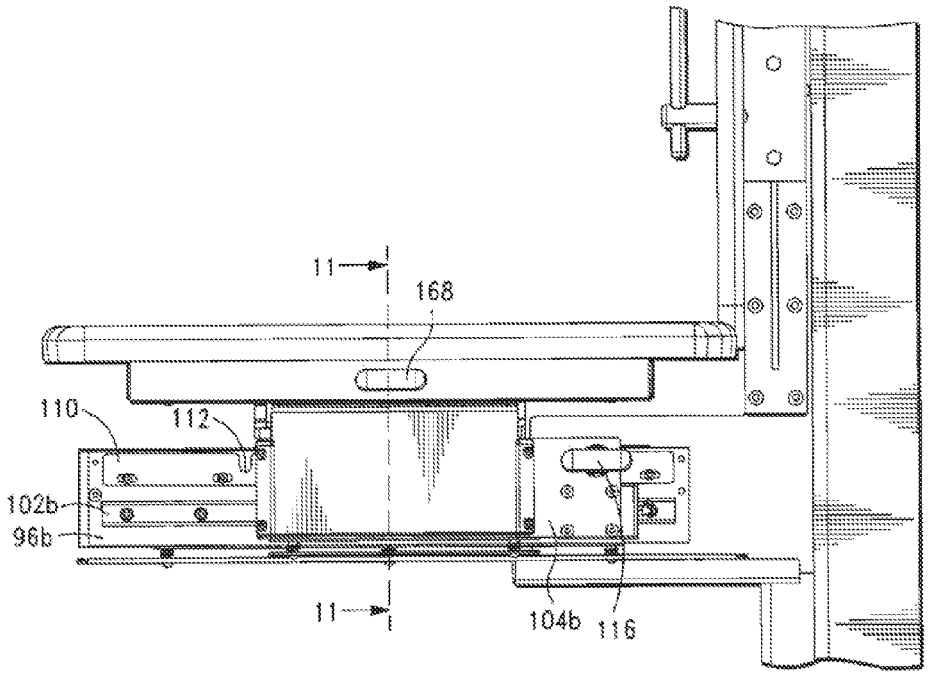
FIG. 10 is a side elevational view of a portion of the table and carriage.

Referring to FIG. 10, a plate 110 is mounted to side bar 96*b* above rail 102*b*. Plate 110 has slots, one of which is shown as 112, each for receiving a pin 114 (FIG. 9) to lock extension arms 104*a* and 104*b* and bearing support plate 108 to side bar 96*b* of frame 86. Pin 114 is joined to a handle 116 (FIG. 10) that extends outwardly from extension arm 104*b*. Pin 114 is slideably mounted to extension arm 104*b* and is preferably biased to a position that engages one of the slots on plate 110 when it is aligned with one of the slots for releasably locking extension arm 104*b* to side bar 96*b*. Slot 112 is positioned near the end of plate 110 for locking the extension arms 104*a* and 104*b* to the frame 86 when the table 16 is in the position shown in FIG. 3. Another slot (not shown) is provided on plate 110 adjacent to the position of handle 116 in FIG. 10 for locking the extension arms 104*a* and 104*b* to the frame 86 when the table 16 is in the position shown in FIGS. 1 and 10.

Referring to FIG. 9, there are safety stop assemblies 118*a*, 118*b*, and 118*c* mounted to bottom surfaces of extension arms 104*a* and 104*b* and frame 86. The safety stop assemblies 118*a*-118*c* prevent vertical movement of carriage 22 when they make contact with an object that is positioned beneath the carriage 22. Each of the safety stop assemblies 118*a-c* has a similar construction. Therefore, only safety stop assembly 118*a* is described in detail herein. The safety stop assembly 118*a* includes a plate 120 that is mounted to the bottom of extension arm 104*a* and another plate 122 that is mounted to plate 120. A plurality of springs, one of which is shown as reference numeral 124, are positioned between plates 120 and 122 such that plate 122 is biased to a position that is spaced from plate 120. When an object makes contact with plate 122, spring 124 compresses and plate 122 moves upwardly. When plate 122 moves upwardly it actuates a switch 123 that is electrically coupled with actuator 28. This causes actuator 28 to become inoperable so that the carriage 22 cannot move vertically downward with respect to column 20.

Figure 11:
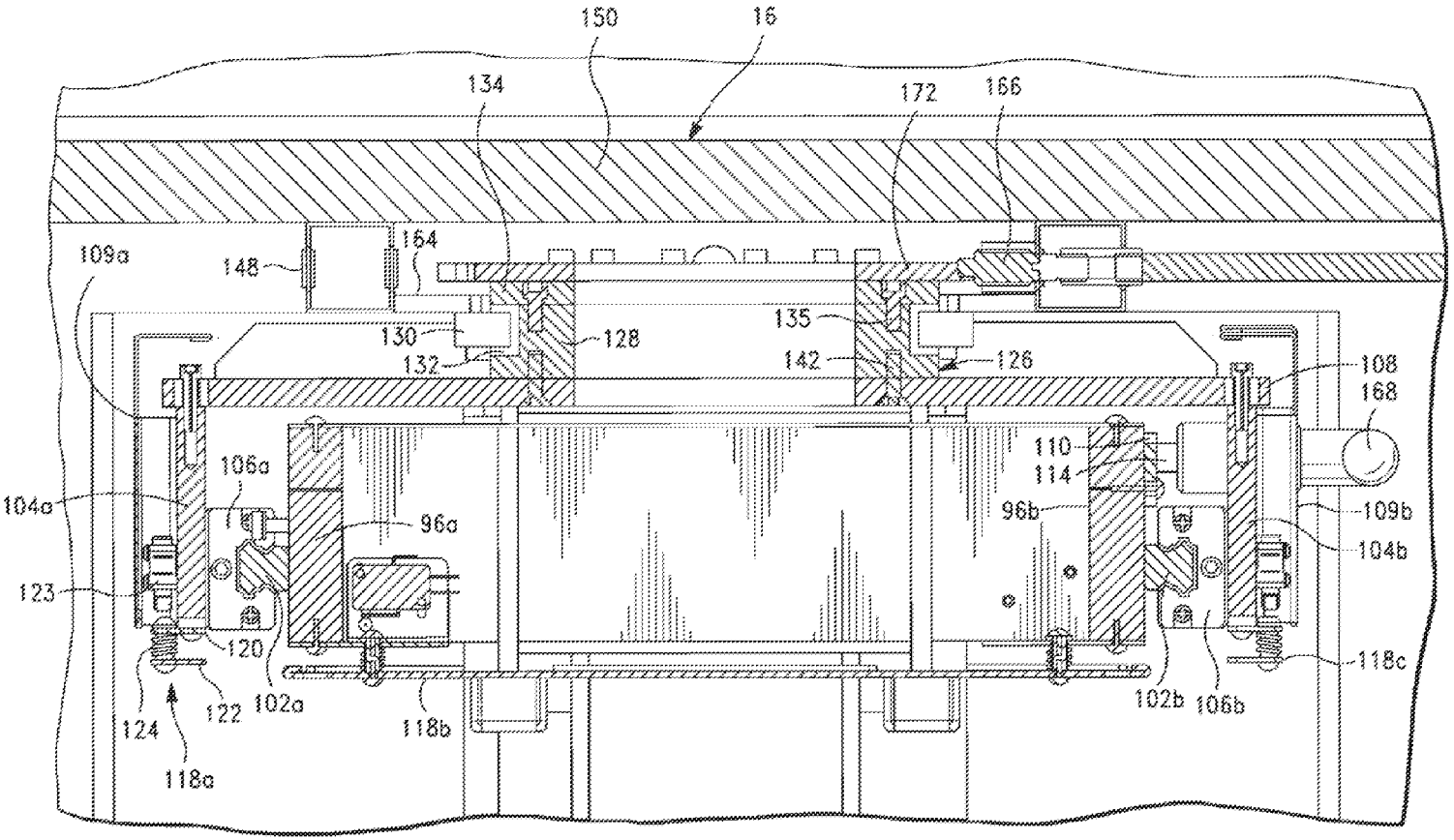
FIG. 11 is a cross-sectional view taken through the line 11-11 of FIG. 10.
Figure 12:
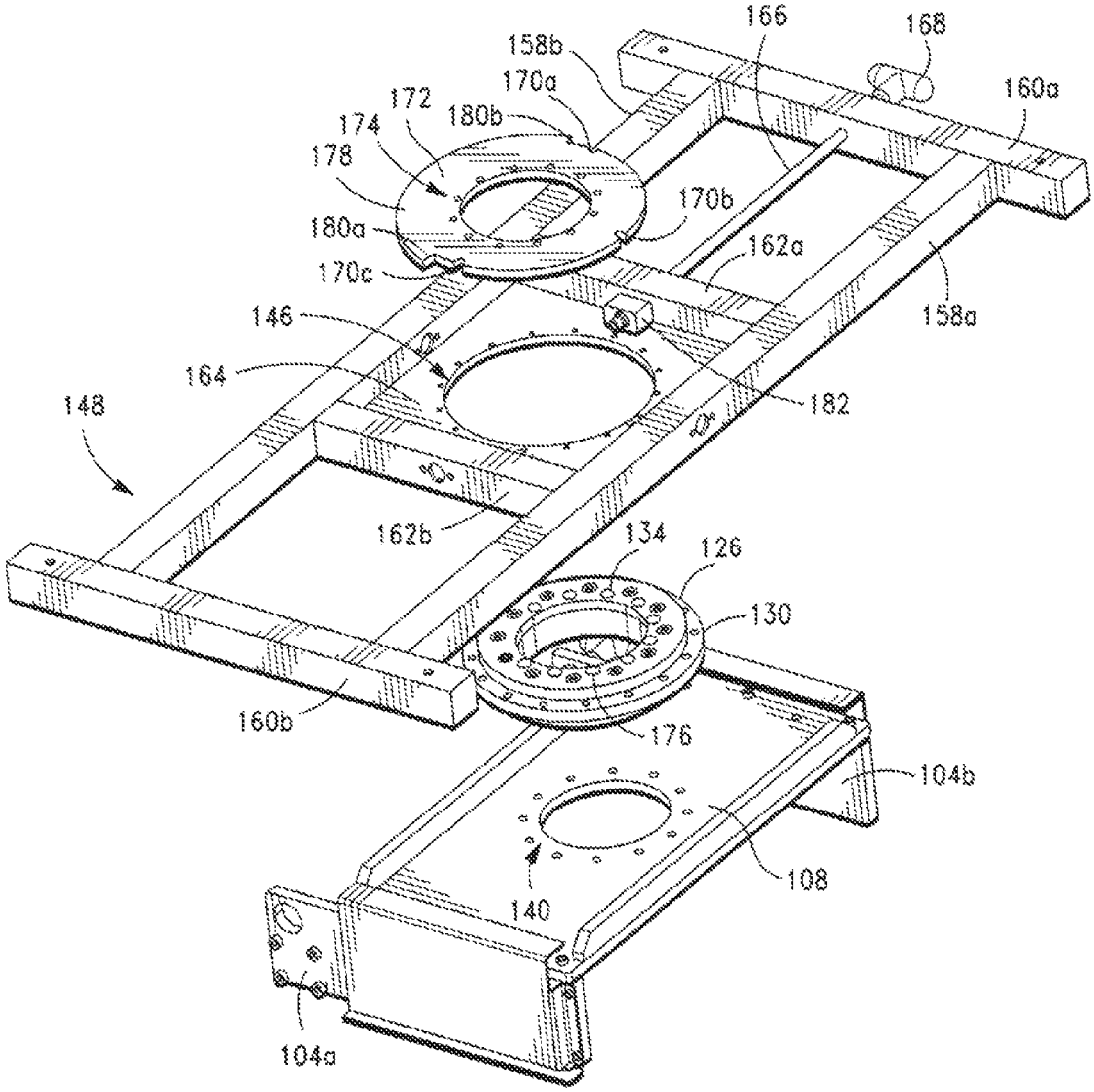
FIG. 12 is an exploded perspective view of a table frame, a bearing, and a bearing support.
Figure 13:
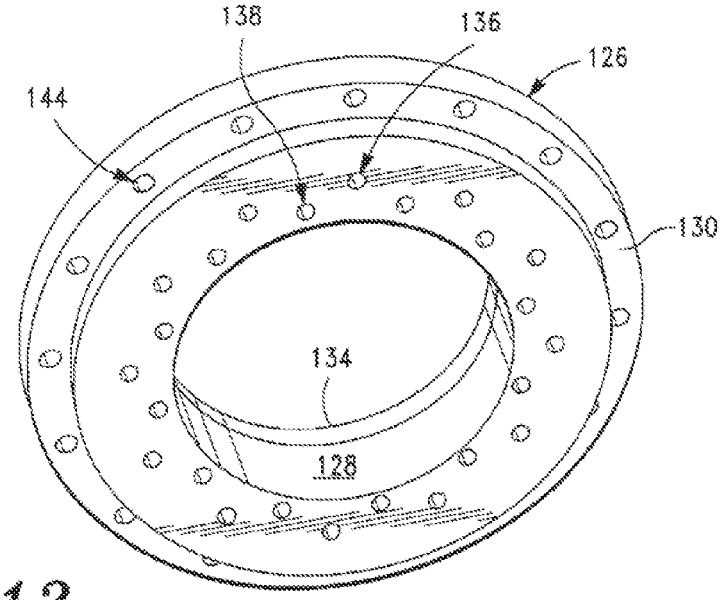
FIG. 13 is a perspective view showing the bottom of the bearing in FIG. 12.

The carriage 22 includes a bearing 126, shown in FIGS. 11-13, that mounts to bearing support plate 108. The bearing 126 has an inner race 128 and an outer race 130 that rotates with respect to the inner race 128. As shown in FIG. 11, the inner race 128 includes a ring 132 of low friction polymeric material 132 with a C-shaped cross section. The outer race 130 is received within the C-shape of the ring 132 for constraining the outer race 130 with respect to the inner race 128. The outer race 130 rotates with respect to the ring 132. The bearing 126 has a top plate 134 that mounts to the inner race 128 with fasteners, one of which is shown as reference numeral 135 in FIG. 11, and secures the ring 132 to the inner race 128. In the exemplary embodiment, the bearing 126 is a polymer clewing ring bearing sold by Igus under the trade name IGLIDE PRT 100.

Referring to FIG. 13, a bottom surface of the inner race 128 has a first set of holes 136 each spaced equidistant from the center of the bearing 126. The bottom surface of the inner race 128 also has a second set of holes 138 each spaced equidistant from the center of the bearing 126. The second set of holes 138 is spaced closer to the center of the bearing 126 than the first set 136. The first set of holes 136 aligns with a set of holes 140 (FIG. 12) on bearing support 108. Fasteners, one of which is shown as reference numeral 142 in FIG. 11, are received by the sets of holes 136 and 140 for mounting inner race 128 to bearing support 108. Outer race 130 has a set of holes 144 (FIG. 13) that aligns with a set of holes 146 provided on a support frame 148 (FIG. 12) of table 16. Sets of holes 144 and 146 receive fasteners (not shown) for mounting outer race 130 to support frame 148. Thus, support frame 148 is rotatable with respect to bearing support 108 via bearing 126.

Figure 16:
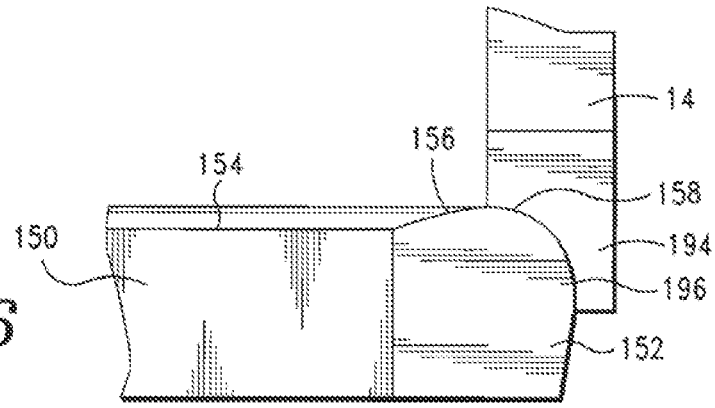
FIG. 16 is a cross-sectional view taken through the line 16-16 of FIG. 9.

Table 16 includes support frame 148 and a tabletop 150 (FIG. 1) that mounts to support frame 148. Tabletop 150 is preferably a thin sheet of stainless steel mounted to a wood substrate. Edging 152 is mounted to the peripheral edge of the tabletop 150. Referring to FIG. 16, the tabletop 150 has an upper surface 154. Edging 152 has a curvilinear upper surface 156 that curves upward from the upper surface 154 of tabletop 150 to an upper point 158 that is above upper surface 154. Because edging 152 extends above the upper surface 154 of tabletop 150, a volume of liquid may be retained by tabletop 150 and edging 152.

Referring to FIG. 12, support frame 148 is generally rectangular with side bars 158*a* and 158*b*, end bars 160*a* and 160*b*, cross bars 162*a* and 162*b* and a bearing mounting plate 164 that mounts to the outer race 130 of bearing 126. A pin 166 is slideably mounted to support frame 148. A handle 168 is mounted to one end of pin 166. The opposite end of pin 166 is configured to be received by slots 170*a*, 170*b*, and 170*c* on a lock plate 172 of carriage 22. The lock plate 172 has a set of holes 174 that aligns with a set of holes 176 provided on the top plate 134 of bearing 126. Fasteners (not shown) are received by the sets of holes 174 and 176 for mounting the lock plate 172 to top plate 134 of bearing 126. Because top plate 134 is mounted to the inner race 128 of bearing 126, lock plate 172 does not rotate with respect to the inner race 128. Thus, lock plate 172 remains stationary as support frame 148 rotates with respect to carriage 22.

When pin 166 is received by one of slots 170*a-c*, table 16 cannot rotate with respect to bearing support plate 108 of carriage 22. To rotate table 16 with respect to bearing support plate 108 of carriage 22, handle 168 is grasped and pulled to slide pin 166 out of the slot 170*a-c* which receives it. Table 16 is then rotated until pin 166 aligns with and engages the desired one of slots 170*a-c*. Pin 166 is preferably biased to a position in which it engages one of slots 170*a-c* when it is aligned with one of the slots such that a force must be applied to handle 168 to remove pin 166 from the slots 170*a-c*. Slots 170*a* and 170*b* are positioned approximately 90 degrees from each other, and slots 170*b* and 170*c* are positioned approximately 90 degrees from each other. The lock plate 172 has an increased diameter section 178 that forms two stop surfaces 180*a* and 180*b*. Surfaces 180*a* and 180*b* contact a block 182 mounted to support frame 148 to prevent support frame 148 from rotating into a position where handle 168 is adjacent to or hidden by back panel 14.

When pin 166 is received by either of slots 170*a* or 170*c*, table 16 is in a first position as shown in FIG. 1. When pin 166 is received by slot 170*b*, table 16 is in a second position as shown in FIG. 3. Referring to FIG. 1, table 16 is rectangular and has a width W and a length L that is greater than the width. In the exemplary embodiment, the length L of table 16 is approximately twice the width W. Specifically, the length L is preferably 44 inches and the width W is preferably 22 inches. The table 16 has a pair of side edges 184*a* and 184*b* that extend the length of the table and a pair of end edges 186*a* and 186*b* that extend the width of the table. When the table 16 is in the first position shown in FIG. 1, the side edge 184*b* is adjacent to the back panel 14. When the table 16 is in the second position shown in FIG. 3, the end edge 186*a* is adjacent to the back panel 14. As described above, before the table 16 is rotated from the position shown in FIG. 1 to the position shown in FIG. 3, it must be slid to the position shown in FIG. 2 by pulling handle 116 (FIG. 10) and sliding table 16 as far forward as possible.

Referring to FIG. 1, back panel 14 has a lower edge 188*a*, upper edge 188*b*, and a pair of side edges 188*c* and 188*d*. Lower edge 188*a* has a length that is approximately the same as the length L of table 16, which is preferably 44 inches, and upper edge 188*b* has a length that is approximately the same as the width W of table 16, which is preferably 22 inches. The height of the back panel 14, or the vertical distance between lower edge 188*a* and upper edge 188*b*, is preferably approximately 35 inches. The side edges 188*c* and 188*d* curve upwardly from the lower edge 188*a* to the upper edge 188*b*. A pair of rails 190*a* and 190*b* are mounted to the front of the back panel 14 adjacent to the side edges 188*c* and 188*d*. The rails 190*a* and 190*b* are provided so that a leash can be tied to the rails 190*a* and 190*b* for restraining an animal positioned on the table 16.

Referring to FIG. 7, back panel 14 is mounted to carriage 22 with a pair of mounting arms 192*a* and 192*b*. Thus, back panel 14 moves vertically with respect to column 20 as carriage 22 moves on column 20. Mounting arm 192*a* is joined with side wall 88*a* of carriage 22 and mounting arm 192*b* is joined with side wall 88*b* of carriage 22. Both of the mounting arms 192*a* and 192*b* are joined to the rear of the back panel 14. Although the back panel 14 is shown as being mounted to carriage 22, it is within the scope of the invention for the back panel 14 to be mounted to another component of table assembly 10, such as column 20, in which case back panel 14 would be stationary. Further, it is within the scope of the invention for the table assembly 10 to not have a back panel at all.

Referring to FIG. 16, edging 194 is mounted to the peripheral edge of back panel 14. Edging 194 has a curvilinear surface 196 that is shaped to mate with the curvilinear surface 156 of edging 152 on tabletop 150. The mating of edging 194 and edging 152 creates a seal.

Thus, liquids running down back panel 14 will flow on top of tabletop 150 without leaking between the mating edges of back panel 14 and tabletop 150.

In operation, the table 16 is lowered into the position shown in FIG. 4 so that an animal can be placed on the table. If the operator determines that access is only needed to one side of the animal, then the table 16 is not slid or rotated with respect to carriage 22. If the operator determines that access is needed to both sides of the animal, then table 16 is first slid horizontally by sliding extension arms 104*a* and 104*b* with respect to frame 86. As shown in FIG. 10, table 16 slides horizontally by grasping and pulling handle 116 to release pin 114 (FIG. 9) from the slot (not shown) in plate 110. Table 16 is then manually slid away from back panel 14 as far forward as possible to a position where pin 114 is forward of slot 112. Table 16 is then rotated with respect to carriage 22. As shown in FIG. 12, table 16 is rotated by grasping and pulling handle 168 to release pin 166 from slot 170*a* in lock plate 172. Table 16 is then manually rotated with respect to carriage 22 until pin 166 aligns with slot 170*b* on lock plate 172. Handle 168 is released so that pin 166 engages slot 170*b* for preventing further rotation of table 16 with respect to carriage 22. After table 16 is rotated, table 16 is horizontally slid toward back panel 14 until pin 114 aligns with and engages slot 112 on plate 110 to lock table 16 from sliding, as shown in FIG. 3. While table 16 is preferably manually slid and rotated, it is within the scope of the invention for table assembly 10 to have one or more motors for sliding and rotating the table 16.

When the table 16 is in the desired position, the animal's leash is tied to one of rails 190*a* and 190*b*, as shown in FIG. 1, to restrain the animal. The table 16 is then raised upward into either the position shown in FIG. 1 or FIG. 3 by directing actuator 28 (FIG. 6) to move piston 28*b* downward within column 20, as discussed above. With the table 16 in the position shown in FIG. 1, one side of the animal on the table 16 can be examined, while the opposite side of the animal faces back panel 14 for increased security. With the table 16 in the position shown in FIG. 3, both sides of the animal can be examined.

While the present invention has been described and illustrated hereinabove with reference to an exemplary veterinary table assembly, it should be understood that various modifications could be made to this assembly without departing from the scope of the invention. For example, in an alternative embodiment, which is not shown in the drawings, the support assembly includes a carriage that is mounted to a support structure, such as a wall. The carriage has a different structure than carriage 22 shown in the drawings and described above. Specifically, the L-shaped box 84 of carriage 22 is replaced with a vertical element, such as a vertical plate, that is configured to be attached to the support structure. A horizontal element, such as frame 86 of carriage 22, is joined to the vertical element and extends outward perpendicularly from the vertical element. A table is mounted to the horizontal element in the same manner as described above with respect to table 16 and frame 86. The table is operable to slide horizontally in a direction that is generally perpendicular to the vertical element of the carriage, and is operable to rotate between a first horizontal position (similar to the position shown in FIG. 1) and a second horizontal position (similar to the position shown in FIG. 3) in the same manner as described above. When the table is in the first horizontal position, one of the side edges of the table is adjacent to the vertical element; when the table is in the second horizontal position, one of the end edges of the table is adjacent to the vertical element. In this embodiment, the back panel 14 is omitted because the wall performs the function of a back panel. Further, in this embodiment, the table and carriage do not move vertically because the carriage is mounted to the support structure, such as a wall. One skilled in the art will appreciate that other embodiments that incorporate one or more of the inventive features described above are also possible and within the scope of the present invention. Therefore, the invention is not to be limited to the exemplary veterinary table assembly described and illustrated hereinabove, except insofar as such limitations are included in the following claims.

What is claimed and desired to be secured by Letters Patent is as follows:

1. A veterinary table assembly, comprising:

a support assembly comprising a column and a carriage mounted to said column;

a back panel mounted to said carriage; and a table mounted to said carriage, said carriage including structure operable to move vertically with respect to said column so as to move said back panel and said table between a lowered position and a raised position, said table including structure operable to move away from said back panel so as to permit rotation of said table at least approximately 90 degrees between a first position and a second position.

2. The veterinary table assembly of claim 1, wherein said table is releasably lockable to said carriage when in each of said first and second positions to prevent rotation of said table with respect to said carriage.

3. The veterinary table assembly of claim 2, wherein said carriage comprises a lock plate comprising first and second slots, and further comprising a pin that is operable to engage each of said first and second slots and prevent rotation of said table, said pin engaging said first slot when said table is in said first position and said second slot when said table is in said second position.

4. The veterinary table assembly of claim 1, wherein said carriage comprises a frame and an extension arm that is slideably mounted to said frame, wherein said carriage further comprises a bearing comprising inner and outer races rotatable with respect to each other, wherein said table is mounted to one of said races and said extension arm of said carriage is coupled to the other of said races.

5. The veterinary table assembly of claim 1, wherein said carriage comprises a frame and an extension arm that is slideably mounted to said frame, and wherein said table is mounted to said extension arm such that it is operable to slide in a direction that is generally perpendicular to said back panel.

6. The veterinary table assembly of claim 5, wherein said extension arm is releasably lockable to said frame when said table is in each of said first and second positions to prevent said table from sliding with respect to said frame.

7. The veterinary table assembly of claim 6, wherein said table is rotatably mounted to said extension arm.

8. The veterinary table assembly of claim 7, wherein said carriage further comprises a pin slideably coupled with said extension arm, said pin operable to engage a first slot provided on said frame when said table is in said first position, and said pin operable to engage a second slot provided on said frame when said table is in said second position.

9. The veterinary table assembly of claim 8, wherein said table is generally rectangular and has a width, and a length that is greater than said width, said table comprising a pair of side edges that extend the length of said table and a pair of end edges that extend the width of said table, wherein one of said side edges is adjacent to said back panel when said table is in said first position, and wherein one of said end edges is adjacent to said back panel when said table is in said second position.

10. The veterinary table assembly of claim 9, wherein said table is releasably lockable to said carriage when in each of said first and second positions to prevent rotation of said table with respect to said carriage.

11. The veterinary table assembly of claim 1, wherein said column comprises a rail and said carriage comprises a guide that engages said rail.

12. The veterinary table assembly of claim 11, further comprising:

an actuator comprising a housing mounted to said column and a piston moveable with respect to said housing, said piston comprising a free end mounting a sliding surface; and an elongate member comprising a first end mounted to said column and a second end mounted to said carriage, said elongate member engaging said sliding surface whereby movement of said piston causes movement of said sliding surface that in turn causes movement of said elongate member that in turn causes movement of said carriage with respect to said column.

13. The veterinary table assembly of claim 12, wherein said sliding surface comprises a first sliding surface and further comprising a second sliding surface mounted to said column, wherein said elongate member engages both of said first and second sliding surfaces, and wherein said first sliding surface is received by a cavity within said column.

14. The veterinary table assembly of claim 12, wherein said sliding surface comprises a sprocket and said elongate member comprises a chain.

15. The veterinary table assembly of claim 1, wherein said table is generally rectangular and has a width, and a length that is greater than said width, said table comprising a pair of side edges that extend the length of said table and a pair of end edges that extend the width of said table, wherein one of said side edges is adjacent to said back panel when said table is in said first position, and wherein one of said end edges is adjacent to said back panel when said table is in said second position.

16. The veterinary table assembly of claim 15, wherein said length is approximately twice said width.

17. A veterinary table assembly, comprising:

a column;

a carriage slideably mounted on said column, said carriage including structure operable to move vertically with respect to said column, said carriage comprising a frame and an extension arm mounted to said frame;

a back panel mounted to said frame of said carriage; and a table mounted to said extension arm of said carriage, wherein said table including structure operable to move on said extension arm away from said frame so as to permit rotation of said table with respect to said extension arm between a first position and a second position.

18. The veterinary table assembly of claim 17, wherein said table is generally rectangular and has a width, and a length that is greater than said width, said table comprising a pair of side edges that extend the length of said table and a pair of end edges that extend the width of said table, wherein one of said side edges is adjacent to said back panel when said table is in said first position, and wherein one of said end edges is adjacent to said back panel when said table is in said second position.

19. The veterinary table assembly of claim 17, wherein said table is releasably lockable to said carriage when in each of said first and second positions to prevent rotation of said table with respect to said carriage.

20. The veterinary table assembly of claim 19, wherein said carriage comprises a lock plate coupled to said extension arm, said lock plate comprising first and second slots, and further comprising a pin that is operable to engage each of said first and second slots and prevent rotation of said table, said pin engaging said first slot when said table is in said first position and said second slot when said table is in said second position.

21. The veterinary table assembly of claim 17, wherein said extension arm is releasably lockable to said frame when said table is in each of said first and second positions to prevent said table from sliding with respect to said frame.

22. The veterinary table assembly of claim 21, wherein said carriage further comprises a pin slideably coupled with said extension arm, said pin operable to engage a first slot provided on said frame when said table is in said first position, and said pin operable to engage a second slot provided on said frame when said table is in said second position.

23. The veterinary table assembly of claim 17, wherein said table is rotatable with respect to said carriage at least approximately 90 degrees between said first position and said second position.

24. A veterinary table assembly, comprising:

a support assembly comprising a vertical element and a horizontal element mounted to said vertical element;

a table mounted to said horizontal element, said table including structure operable to slide horizontally in a direction that is generally perpendicular to said vertical element so as to permit rotation of said table, said table including structure operable to rotate with respect to said vertical element at least approximately 90 degrees between a first horizontal position and a second horizontal position; and wherein said table has a width and a length that is greater than said width, said table comprising a pair of side edges that extend the length of said table and a pair of end edges that extend the width of said table, wherein one of said side edges is adjacent to said vertical element of said support assembly when said table is in said first horizontal position, and wherein one of said end edges is adjacent to said vertical element of said support assembly when said table is in said second horizontal position.

25. The veterinary table assembly of claim 24, wherein said table is operable to move vertically between a lowered position and a raised position.

26. The veterinary table assembly of claim 25, wherein said vertical element comprises a column and said horizontal element comprises a carriage slideably mounted to said column, and wherein said table is mounted to said carriage to permit said table to move vertically between said lowered and raised positions.

27. The veterinary table assembly of claim 26, wherein said table is releasably lockable to said carriage when in each of said first and second horizontal positions to prevent rotation of said table with respect to said carriage.

28. The veterinary table assembly of claim 26, wherein said carriage comprises a frame and an extension arm that is slideably mounted on said frame, and wherein said table is mounted to said extension arm such that it is operable to slide horizontally with respect to said frame.

29. The veterinary table assembly of claim 28, wherein said extension arm is releasably lockable to said frame when said table is in each of said first and second horizontal positions to prevent said table from sliding with respect to said frame.

30. The veterinary table assembly of claim 24, wherein said table is releasably lockable to said support assembly to prevent rotation and sliding of said table with respect to said support assembly.

31. The veterinary table assembly of claim 24, further comprising a back panel mounted to said support assembly.

32. The veterinary table assembly of claim 31, wherein one of said side edges of said table is adjacent to said back panel when said table is in said first horizontal position, and wherein one of said end edges of said table is adjacent to said back panel when said table is in said second horizontal position.

* * * * *